United States Patent [19]

Bennink et al.

[11] 3,950,835

[45] Apr. 20, 1976

[54] FAN ASSEMBLY AND METHOD OF MANUFACTURING SAME

[75] Inventors: William D. Bennink, Kirkville; Charles K. Griffin, Auburn, both of N.Y.

[73] Assignee: Carrier Corporation, Syracuse, N.Y.

[22] Filed: Oct. 2, 1974

[21] Appl. No.: 511,333

[52] U.S. Cl. ..... 29/156.4 R; 415/206; 415/219 C

[51] Int. Cl.[2] ..... F04D 29/44; B23P 15/00

[58] Field of Search ..... 417/362; 415/219 C, 415/206, 126; 29/428, 156.4 R, 156.8 CF, 428, 455

[56] References Cited

UNITED STATES PATENTS

| | | | |
|---|---|---|---|
| 2,268,046 | 12/1941 | Marker et al. | 417/362 |
| 2,482,519 | 9/1949 | Schwarz | 415/219 C |
| 3,174,541 | 3/1965 | Brandt et al. | 415/219 C |
| 3,561,906 | 2/1971 | Fermer | 415/206 |
| 3,726,611 | 4/1973 | Astrom | 415/126 |

FOREIGN PATENTS OR APPLICATIONS

| | | | |
|---|---|---|---|
| 741,975 | 12/1955 | United Kingdom | 415/126 |

*Primary Examiner*—Henry F. Raduazo
*Attorney, Agent, or Firm*—J. Raymond Curtin; Barry E. Deutsch

[57] ABSTRACT

A fan assembly including a fan scroll having a discharge opening. The relative position of the opening may be altered from one unit to the next to direct the air in a desired direction. The fan shaft is mounted off-center relative to the center of the side walls of the fan assembly housing. The position of the fan shaft is varied about the circumference of an imaginary circle in accordance with the position of the discharge opening. The center of the imaginary circle is coincident with the center of the side walls.

2 Claims, 8 Drawing Figures

FAN ASSEMBLY AND METHOD OF MANUFACTURING SAME

BACKGROUND OF THE INVENTION

This invention relates to a fan assembly disposed within a housing and to a method of manufacturing the same.

Fan assemblies of various sizes and configurations are employed in many diversified installations. A fan assembly may be employed to merely ventilate an area, or may be included as part of a central station air handling unit wherein cooling, humidifying and dehumidifying, heating, filtration, and precise air circulation may be obtained from the unit. Such central station air handling units are typically employed in high-rise buildings, industrial plants, and shopping malls having multizone, double duct, or single zone constant or variable volume air distribution systems. The central station air handling unit may either include a blow-thru or draw-thru fan. The desired position of the fan relative to the cooling and heating coils determines the type of fan, either blow-thru or draw-thru, employed in any given installation. Air will be discharged from the fan assembly in a preselected direction depending upon the individual requirements of each installation.

For example, in one installation, it may be desirable to have the air discharged from the bottom horizontal front of the unit. In another installation, it may be desirable to have the air discharged from the top rear of the unit, whereas in still a further installation, it may be desirable to have the air discharged in a top horizontal front direction.

Fan assemblies of the type hereinabove described are generally disposed within a housing. Heretofore, it has been the practice within the industry to provide separate housing configurations depending upon the direction in which the air is discharged from the fan assembly. The utilization of the various housings has thus increased the number of parts that must be maintained in inventory.

It might be thought that a single housing could be readily employed with the various discharge arrangements that are desired for a fan assembly. However, a fan scroll is not a symmetrical body, but rather typically includes a portion adjacent the discharge opening which is substantially wider than the remaining portion of the fan scroll. To accommodate the wide portion of the fan scroll, the position of which may vary from unit to unit, the housing portion therearound must be suitably expanded. The expanded portion of a housing suitable for one discharge arrangement, for example a housing useable with a front discharge opening fan scroll, would not be suitable for another discharge arrangement, for example a housing to be employed with a top discharge opening fan scroll. Heretofore, a single housing suitable for use with all discharge arrangements would necessarily be expanded or oversized in all dimensions to accommodate the fan scroll as the position of the discharge opening might be varied from one unit to the next. Obviously, the extra material unnecessarily employed in making an over-sized housing increases the cost of manufacturing and selling the air handling units. Additionally, suitable members must be employed to satisfactorily support the extra heavy housing panels. Particularly, when raw material shortages are affecting all segments of industry, a housing having excessive amounts of superfluous material is not satisfactory.

A further unnecessary expense is created by use of oversized housings in that transportation costs are materially increased due to the extra weight involved.

SUMMARY OF THE INVENTION

Accordingly, it is an object of the invention to manufacture a fan assembly of a type that is disposed within a housing.

It is another object of the invention to manufacture a housing for a fan assembly that may be economically employed with various discharge arrangements.

It is a further object of the invention to manufacture a compact fan assembly housing useable with various air discharge arrangements.

It is yet another object of the invention to manufacture a housing for a fan assembly that has a minimum of excess material.

These and other objects of the instant invention are obtained by providing a fan assembly disposed within a housing, the housing having a first panel having an opening for the discharge of air from the fan. The housing further includes first and second side panels. The fan shaft of the fan assembly is mounted in the housing off-center relative to the side panels. The position of the fan shaft is varied about the circumference of an imaginary circle in accordance with the position of the first panel. The position of the first panel is fixed to discharge the air in a desired direction. The center of the imaginary circle is coincident with the center of the side panels.

DESCRIPTION OF THE PREFERRED EMBODIMENT

Figure 1:
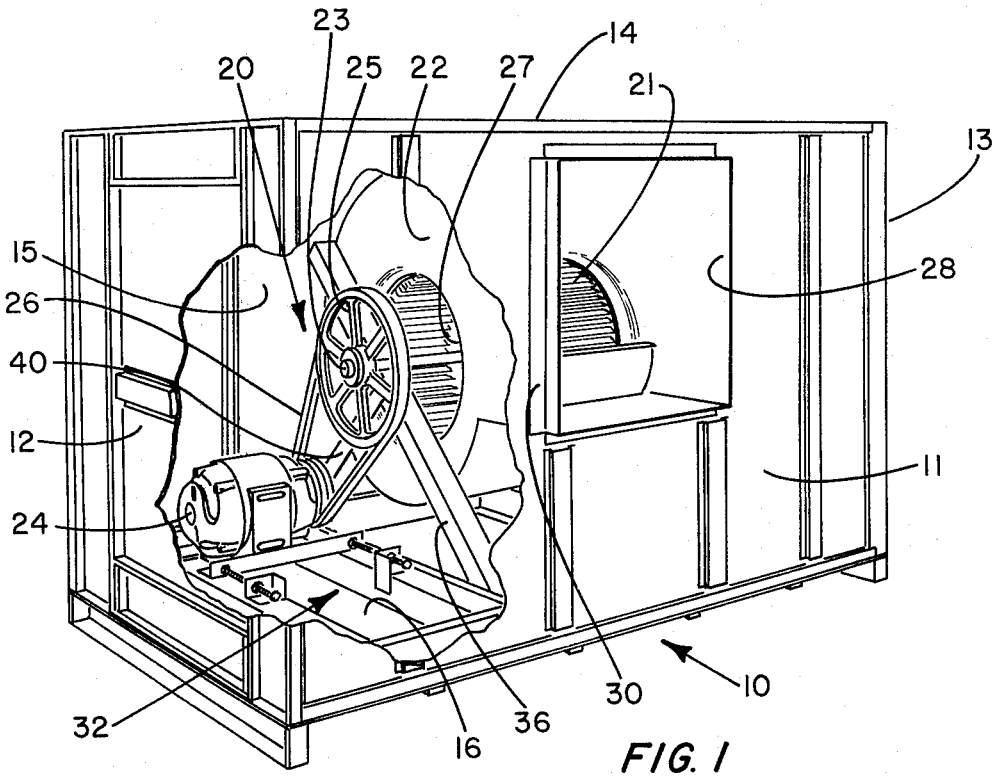
FIG. 1 is a perspective view, partially broken away, illustrating a preferred embodiment of the present invention.

Referring now to the drawings, there is disclosed a preferred embodiment of the present invention. In referring to the various figures of the drawings, like numerals shall refer to like parts.

Referring now particularly to FIG. 1, there is disclosed a housing 10, having a front panel or wall 11, side panels 12 and 13, top panel 14, rear panel 15 and bottom panel 16, provided to house a fan assembly generally designated as 20. Depending upon the unit configuration, typically either rear panel 15 or bottom panel 16 is omitted to permit the ingress of air. The size of housing 10 is typically dictated by the size of the fan assembly employed. As noted previously, fan assemblies of various sizes and configurations are employed in many diversified installations. The fan assembly and housing illustrated in FIG. 1 is particularly suitable for use as part of a central station air handling unit wherein cooling, humidifying, dehumidifying, heating, filtration, and precise air circulation may be obtained.

Figure 2:
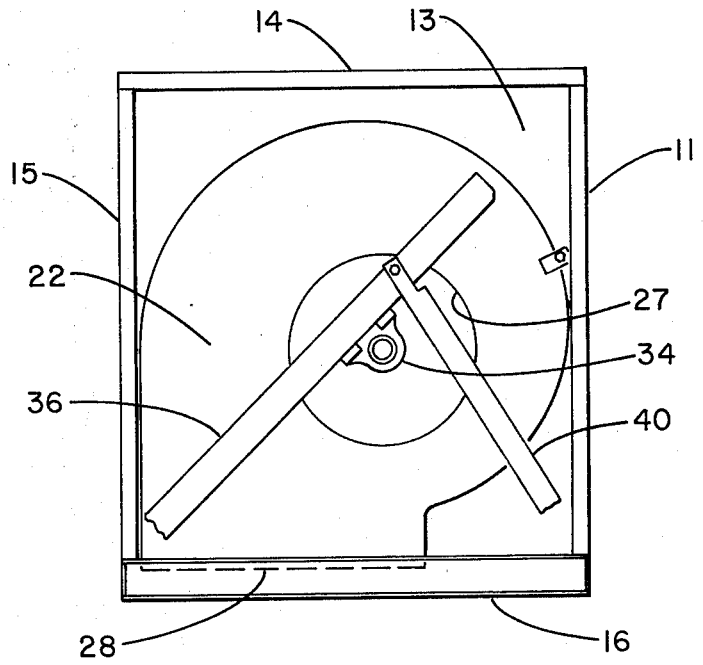
FIG. 2 is a plan view illustrating a fan scroll positioned within a housing to direct air in a first direction.

Fan assembly 20 includes a fan 21 mounted in a fan scroll 22. Fan shaft 23 is operatively connected to an electric motor 24 via a pulley 25 and a belt 26. Energization of motor 24 causes fan 21 to rotate to obtain desired air flow. Air is drawn into the fan through opening 27 provided in the side wall of the fan scroll and is discharged therefrom through a suitable opening provided in the end wall of the fan scroll (see for example FIG. 2) whereat the discharge opening in the fan scroll is indicated by reference numeral 28. The discharge opening in the fan scroll is aligned with discharge opening 30 provided in front panel 11. As will be observed with reference to FIGS. 2 thru 6, the position of opening 30 will be varied depending upon the position of fan scroll opening 28.

Electric motor 24 is mounted on a base 32 which also supports fan assembly 20. A first elongated support member 36 is provided to rigidly connect the fan assembly to support base 32. In addition, support member 36 has fan shaft bearing 34 mounted thereon as is shown in FIGS. 2 thru 6. A second structural support member 40, somewhat smaller than member 36, provides additional strength for the support system of the fan assembly.

With particular reference to FIG. 1, it is readily noted that it is to the benefit of both the manufacturer and ultimate user to maintain housing 10 as compact as possible. A compact housing is not only highly desirable to maintain manufacturing costs at a minimum, but is also desirable from the users viewpoint since a reduction in the space required for the air handling unit increases the space available for other purposes.

Figure 3:
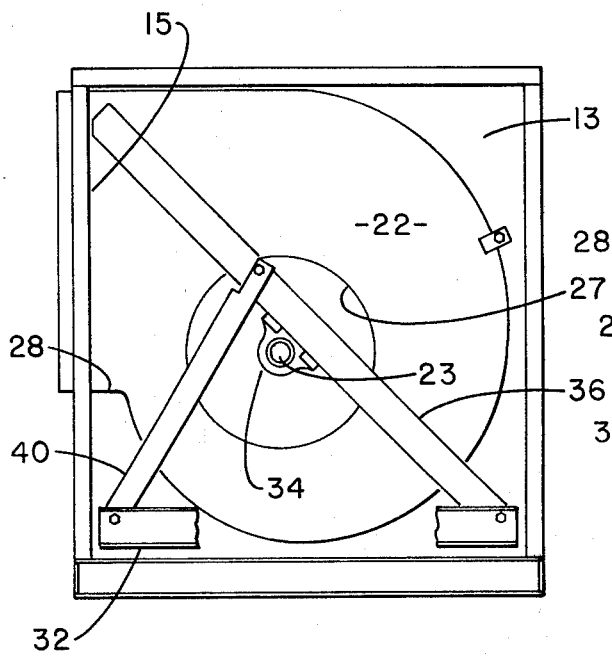
FIG. 3 is a view similar to FIG. 2 illustrating the fan scroll positioned to direct air in a second preselected direction.

With particular reference to FIGS. 2 thru 6, it is readily apparent that, depending upon a given installation, the air discharged from the fan through openings 28 and 30 may be required to be directed in a different manner from one unit to the next. For example, in FIG. 2, the discharge openings in the fan scroll and housing are provided at the bottom rear of the unit. In FIG. 3, the discharge openings have been moved to the rear top of the unit; whereas in FIG. 4, the discharge openings are provided at the rear bottom of the unit. It should be noted that it is necessary to rotate fan shaft 23 180° about its axis to obtain some of the illustrated positions. For example, it is necessary to rotate the fan shaft in the manner indicated to obtain the configuration illustrated in FIG. 3, from that illustrated in FIG. 4. In addition, it would be necessary to reverse the position of pulley 25 on shaft 23 in order to maintain the pulley in the same relative position as that illustrated in FIG. 1.

As is known to those skilled in the art, a fan scroll is not a symmetrical object, but rather, the scroll is defined by a curve of increasing radius, with the maximum radius of the scroll falling substantially adjacent the discharge portion thereof. In essence, the scroll is spiral-shaped. Thus, a compact housing provided for a fan assembly suitable to discharge air in one direction, for example in the direction illustrated in FIG. 2, would not necessarily be suitable for use with a fan assembly intended to direct air in a different direction (for example that illustrated in FIG. 3).

In order to maintain the size of the housing as compact as possible, yet be able to employ the identical housing with the various discharge arrangements illustrated, fan shaft 23 of fan assembly 20 is mounted off-center or eccentrically relative to end panels 12 and 13 of housing 10. As is observed, with reference to FIGS. 2 thru 6, the position of the fan shaft is varied depending upon the position of the discharge opening of the fan scroll.

Figure 7:
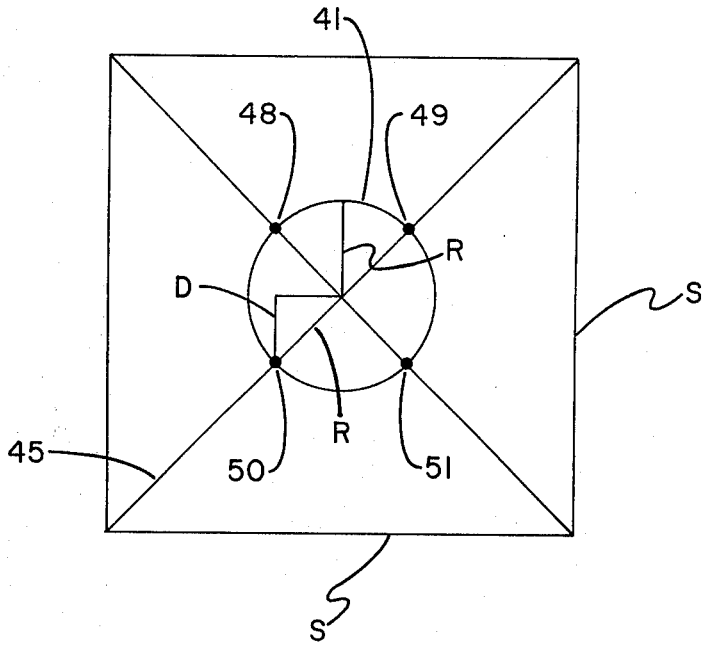
FIG. 7 is a plan view of a side panel of the fan assembly housing showing preferred fan shaft locations for the embodiments illustrated in FIGS. 2 thru 6.

With reference to FIG. 7, the manner in which the ideal location of the fan shaft is obtained for each discharge arrangement is illustrated. A circle 41 whose center is coincident with the center of side-panel 12 is drawn thereon. In actual practice, the circle is imaginary. The radius of circle 41 is labeled R. A perpendicular from a point on the circumference of the circle intersecting a 45° diagonal line 45, to a radius drawn horizontally through the center of the circle, is represented by line D. The total width of the panel is indicated by line S.

Figure 8:
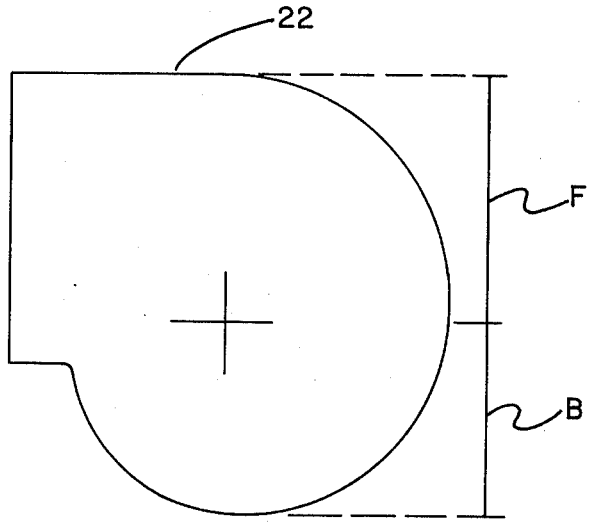
FIG. 8 is a plan view of a fan scroll of the type illustrated herein.

With reference to FIG. 8, there is shown a plan view of a side wall of fan scroll 22. The major radius of the spiral-shaped fan scroll is represented by line F. The radius of the fan scroll in axial alignment with radius F is represented by line B. The addition of radii $F + B$ equals the dimension S. The dimension S thus represents the ideal minimum width for a housing side panel for a known fan scroll. In actual commercial practice, the attachment of insulation to the inner walls of the housing panels will make S somewhat larger than the calculated ideal size. For any given fan scroll, the length of radii F and B are known.

Again, referring to FIG. 7, the sine of 45° is equal to $D/R$. Since the sine of 45° equals 0.707, $D$ is equal to 0.707R. The dimension $F$ is equal to $S/2 + D$ or $F$ is equal to $S/2 + .707R$. Dividing the entire equation by 0.707 leaves $$\frac{F}{.707} = \frac{S}{1.414} + R$$

or $$R = \frac{F}{.707} - \frac{S}{1.414} = \frac{2F - S}{1.414}.$$

Since $F + B = S$ and both F and B are known for any given fan scroll, $R$ which is the radius of the circle which defines the locus for all positions of the fan shaft may be readily computed.

By varying the position of the fan shaft about the circumference of the imaginary circle in accordance with the position of the discharge opening, a single housing having minimum size may be employed with the different discharge arrangements. The points on FIG. 7 labeled 48, 49, 50 and 51 represent the ideal locations for the fan shaft depending upon the particular discharge arrangement employed. As will be observed, the fan shaft will be disposed at an angle of 45° relative to the intersection of horizontal and vertical planes through the center of side panels 12 and 13 as it is moved about the circumference of circle 41. By positioning the fan shaft eccentrically relative to the side panels of the housing, and varying the position of the shaft in accordance with the particular discharge arrangement, a single, compact housing may be satisfactorily employed with the different discharge arrangements. Essentially, by selectively positioning the fan shaft about the circumference of the imaginary circle 41, the dimensions of housing 10 may be maintained at a minimum.

Figure 4:
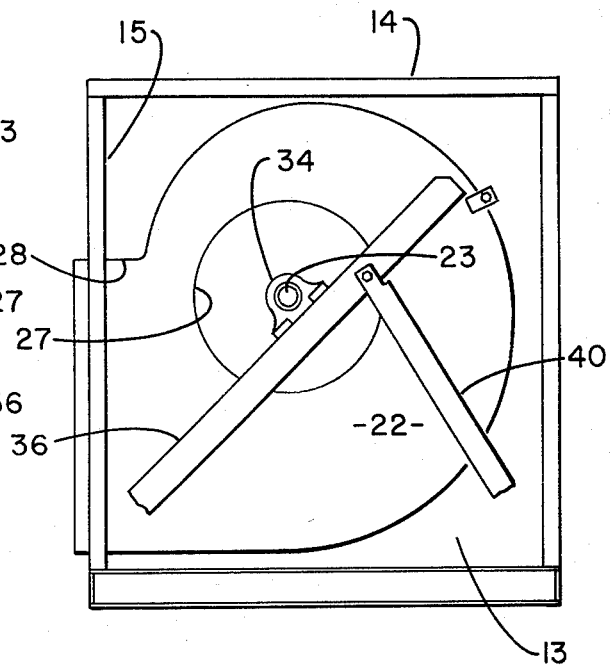
FIG. 4 is a view similar to FIGS. 2 and 3 illustrating the fan positioned to direct air in a third preselected direction.
Figure 5:
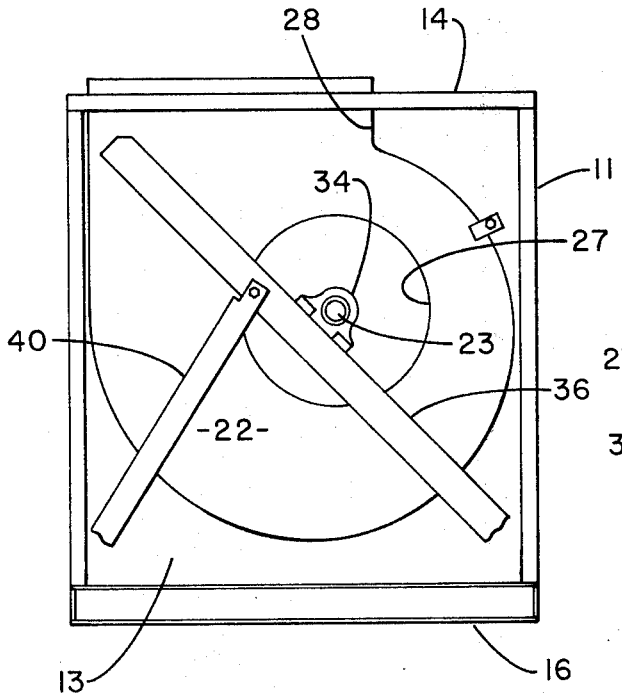
FIG. 5 is a further plan view illustrating the fan positioned to direct the air in a fourth preselected direction.
Figure 6:
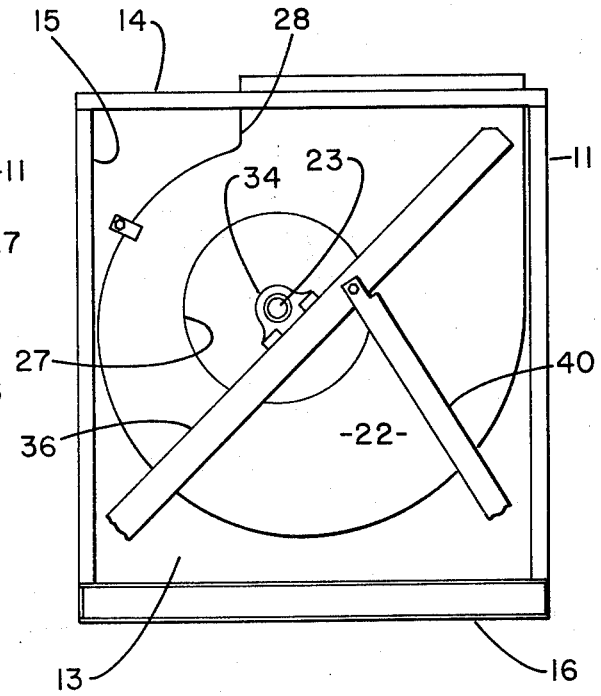
FIG. 6 is yet another plan view illustrating the fan positioned to direct the air in a fifth predetermined direction.

A secondary benefit is derived from the invention in that the panel having discharge opening 30 in the embodiments of FIGS. 3 and 4, is identical to the panel having discharge opening 30 in the embodiments of FIGS. 5 and 6. That is, the size of the opening and its relative position remains constant for all the discharge positions of the fan scroll. Accordingly, the same panel may be employed for all four embodiments. This reduces the number of parts that must be maintained in inventory, thereby further reducing the manufacturing cost of the assembly.

While a preferred embodiment of the present invention has been described and illustrated, the present invention should not be limited thereto, but may be otherwise embodied within the scope of the following claims.

We claim:

1. A method of manufacturing a fan assembly of a type disposed within a housing having a peripheral wall defined by sides of a rectangle and having a fan scroll disposed therein comprising the steps of:

rotating the fan assembly on a support member so that the discharge opening and the fan scroll is positioned to direct the air in a preselected direction; out one of the peripheral side walls of the rectangle;

providing a first housing peripheral side wall having an opening in alignment with the discharge opening in the fan scroll;

providing first and second housing side panels, the shaft of the fan assembly being disposed off center relative to the center of said side panels, the position of the fan shaft being intersecting diagonals fixed about the circumference of an imaginary circle whose center is coincident with the center of the diagonals of the side panels, the imaginary circle defining the locus of all positions of said fan shaft, with the radius of the imaginary circle being determined substantially in accordance with the following equation:

$$R = \frac{2F - S}{1.414}$$

where:

$F$ is the major radius of the fan scroll; and $S$ is the length of a side of a square circumscribed about the fan scroll and equals $F + B$ where:

$B$ is the radius of the fan scroll in axial alignment with $F$; and fixing the position of said fan shaft on said imaginary circle in accordance with the position of said discharge opening in one of the sides of the rectangular housing.

2. A method of manufacturing a fan assembly in accordance with claim 1 wherein the center of the fan shaft is disposed on a line drawn at a 45° angle relative to the intersection of horizontal and vertical planes drawn through the center of said side panels.

* * * * *